US005144882A

United States Patent [19]

Weissgerber

[11] Patent Number: 5,144,882

[45] Date of Patent: Sep. 8, 1992

[54] SHAFT SEAL SYSTEM FOR A PISTON PUMP SEPARATING IMPURITIES

[75] Inventor: Hans G. Weissgerber, Waldbronn, Fed. Rep. of Germany

[73] Assignee: Hewlett-Packard Company, Palo Alto, Calif.

[21] Appl. No.: 598,894

[22] Filed: Oct. 16, 1990

[30] Foreign Application Priority Data

Oct. 17, 1989 [DE] Fed. Rep. of Germany ... 8912315[U]

[51] Int. Cl.[5] ..... F01B 31/00; F16L 17/00

[52] U.S. Cl. ..... 92/87; 92/168; 277/24; 417/489

[58] Field of Search ..... 277/24, 123, 125, 23, 277/58; 92/82, 87, 168, 171.1; 417/489

[56] References Cited

U.S. PATENT DOCUMENTS

| | | | |
|---|---|---|---|
| 2,367,185 | 1/1945 | Cary | 92/87 |
| 2,545,506 | 3/1951 | Walsh | 92/87 X |
| 2,587,474 | 2/1952 | Howard | 277/23 |
| 2,595,878 | 5/1952 | Parsons | 92/82 |
| 2,765,185 | 10/1956 | Mott | 277/124 |
| 3,345,076 | 10/1967 | Wheelock | 277/24 |
| 3,659,306 | 5/1972 | Stoltze et al. | 277/24 X |
| 4,155,560 | 5/1979 | Repella | 277/24 X |
| 4,609,146 | 9/1986 | Walto | 277/24 X |
| 4,826,181 | 5/1989 | Howard | 277/125 X |
| 4,878,815 | 11/1989 | Stachowiak | 92/171.1 X |
| 4,943,068 | 7/1990 | Hatch et al. | 277/23 |
| 4,991,495 | 2/1991 | Loegel, Sr. et al. | 277/125 X |

FOREIGN PATENT DOCUMENTS

| | | | |
|---|---|---|---|
| 0309596 | 5/1989 | European Pat. Off. . | |
| 913603 | 6/1954 | Fed. Rep. of Germany . | |
| 1010033 | 6/1957 | Fed. Rep. of Germany | 277/24 |
| 1334849 | 10/1962 | France | 277/24 |

OTHER PUBLICATIONS

O+P Ölhydraulik und Pneumatik, 31 (May 1987), Nr. 2, p. 121.

*Primary Examiner*—Edward K. Look
*Assistant Examiner*—John Ryznic

[57] ABSTRACT

A piston pump shaft sealing system is provided which prevents particles released from the shaft seal, as a result of wear from entering and contaminating the fluid being pumped. The system features a permeable, deformable disc disposed between the seal and the displacement chamber of the pump. The piston shaft extends through a centrally exposed hole in the disc. In its undeformed state, the hole in the disc is smaller than the diameter of the piston shaft so that when the shaft is forced through the hole, the edges of the hole are pressed against the surface of the shaft, thereby scraping off seal particles deposited on the shaft. Forcing the shaft through the hole also deforms the disk into a conical shape, thereby forming an annular cavity between the disc and the seal which surrounds the piston shaft. The cavity serves to capture and retain the sealed particles, thereby preventing them from entering the fluid. The disc is permeable with respect to the fluid, thereby ensuring rapid wetting of the seal area at pump startup, rapid flushing of the seal system following change over of the fluid, and minimizing the pressure differential across the disc.

3 Claims, 1 Drawing Sheet

SHAFT SEAL SYSTEM FOR A PISTON PUMP SEPARATING IMPURITIES

BACKGROUND OF THE INVENTION

The invention relates to a shaft seal system for a piston pump. More specifically, the invention relates to a sealing system which prevents debris from seal wear from contaminating the fluid being pumped.

Piston pumps are frequently used in high pressure applications, such as liquid chromatography. Typically, such pumps employ a shaft seal which surrounds the shaft at bottom dead center. Sealing is effected by pressing a lip portion of the seal against the shaft using a spring disposed in an annular groove in the seal. Typically, such seals are formed from polytetrafluorethylene (PTFE) impregnated with graphite fibers.

Unfortunately, such seals are subject to wear as a result of abrasion between the seal lip and the shaft. This wear causes small particles of the seal—that is, particles of PTFE or graphite fibers—to be flushed into the fluid being pumped. Such contamination of the fluid can cause damage to valves, plug capillaries and, in the case of liquid chromatography, destruction of the chromatographic separation column. Traditionally, such problems have been avoided by placing filters in the fluid downstream of the pump to capture the seal debris. However, this approach suffers from the drawbacks of increased maintenance due to the need for frequent filter replacement and increased complexity of the fluid system.

Accordingly, it would be desirable to provide a seal which prevented seal wear debris from contaminating the fluid being pumped.

SUMMARY OF THE INVENTION

It is the object of the current invention to provide a pump shaft sealing system capable of preventing seal particles, released as a result of wear, from contaminating the fluid being pumped.

It is a further object of the current invention to provide a sealing system capable of capturing and retaining such seal particles.

It is still a further object of the current invention to provide a sealing system capable of flushing the seal with the fluid being pumped.

These and other objects are achieved in a piston pump for pumping a fluid, comprising a housing having a chamber formed therein, a shaft movably disposed in the chamber, a shaft seal disposed in the housing and surrounding the shaft, and means, disposed inboard of the seal, for capturing particles of seal material separated from the seal, for example by wear, thereby preventing such seal particles from contaminating the fluid. The capturing means preferably comprises a cavity adjacent to and surrounding the shaft. The pump also comprises means for removing particles of seal from the shaft which have been deposited thereon. Preferably, the removing means is a scraper formed by elastically deforming a disc about the shaft. The disc and the seal form the aforementioned cavity therebetween. The disc features a centrally formed hole conforming to the cross-sectional shape of the shaft, the size of the hole being smaller than the cross-sectional size of the shaft, so that the edge of the hole encircles and contacts the shaft. The disc is preferably made of porous polytetrafluorethylene.

In operation, the shaft moves back and forth through the disc hole and the edges of the hole scrape particles from the shaft surface which have been released by the seal as a result of wear. As a result of the elastic deformation of the disc about the shaft, the disc takes a conical shape, forming a cavity between the disc and the seal which captures and retains the particles scraped off by the disc, thereby preventing these particles from contaminating the fluid system.

The disc is permeable with respect to the fluid being pumped. This allows the fluid to flush the seal and minimizes the pressure gradient across the seal. In the preferred embodiment, the disc is formed from a porous PTFE material. In an alternative embodiment, the seal is metal and has a plurality of holes formed therein.

DESCRIPTION OF THE PREFERRED EMBODIMENT

Figure 1:
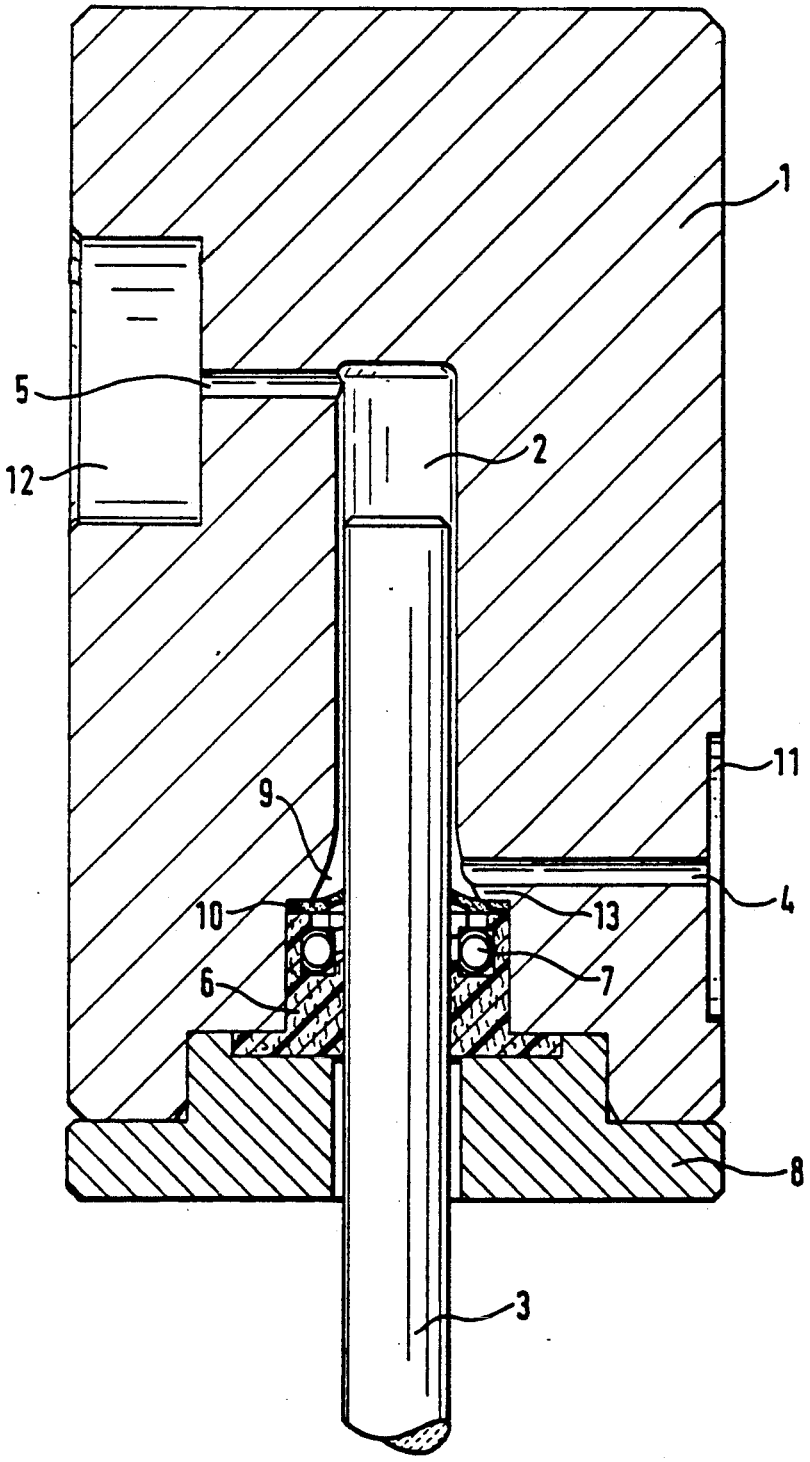
FIG. 1 is a longitudinal cross-section through a piston pump.

There is shown in FIG. 1 a piston pump, such as may be used in high pressure fluid pumping service—for example, liquid chromatography. The pump is comprised of a housing 1 in which a cylindrical displacement chamber 2 is formed. A cylindrical piston shaft 3 is slidably disposed in the displacement chamber 2 and, as a result of a driver, not shown, reciprocates back and forth in the displacement chamber. The diameter of the piston shaft 3 is less than the diameter of the displacement cavity 2 so that fluid can flow between the piston shaft and the wall of the displacement chamber. An inlet 4 and an outlet 5 are formed in the housing 1 and allow the fluid being pumped to communicate with the displacement chamber. The inlet 4 connects with the bottom of the displacement chamber—that is, the end of the displacement chamber in which the piston shaft 3 resides at the bottom of its outward stroke. The outlet 5 connects with the top of the displacement chamber—that is, the end of the displacement chamber in which the piston shaft resides at the top of its inward stroke. Recesses 11 and 12 are formed in the housing 1 and facilitate the connection of supply and discharge lines, not shown, to the pump inlet 4 and outlet 5, respectively.

In operation, fluid is drawn into the displacement chamber 2, through the inlet 4, during the outward stroke of the piston shaft 3. The fluid is pressurized and discharged from the pump, through the outlet 5, by the piston shaft on its inward stroke. Typically, a check valve, not shown, is installed in the inlet supply line to prevent the flow of fluid out of the inlet 4 during the inward stroke of the piston shaft.

The piston shaft 3 is sealed by a seal 6 which is disposed in the housing 1 at the bottom of the displacement chamber 2 in the area where the piston shaft enters the housing. The seal 6 is cylindrical in shape and surrounds the piston shaft. A ring-shaped spring 7 resides in an annular groove in the seal and presses the inner portion of the seal against the surface of the piston shaft and presses the outer portion of the seal against the housing. A retainer 8 is disposed at one end of the housing and presses the seal 6 into its correct position.

As a result of the high velocity of the piston shaft and the surface contact between the piston shaft 3 and the seal 6, wear is experienced. Since the shaft is typically made of a hard material and the seal is made of a deformable material, the wear occurs predominantly on the seal. As a result of this abrasive wear, small particles of seal material are detached from the seal. If, as is frequently the case, the seal is made of a PTFE impregnated with graphite fibers, small particles of PTFE and graphite fibers are released by the wear. Under the sealing system heretofore used in the art, these particles were deposited onto the surface of the shaft and carried by the shaft into the fluid being pumped, thereby contaminating the fluid.

According to the current invention, contamination of the fluid by seal particles is prevented by the use of a member 10 disposed inboard of the seal—that is, between the inboard face of the seal 6 and the displacement chamber 2. In the preferred embodiment, the member 10 is a disc as shown in FIG. 1. The inboard face of the disc 10 is adjacent the bottom of the displacement chamber and the outboard face of the disc is adjacent the seal 6. Thus, the seal 6 retains the disc by pressing it against a shoulder 13 formed in the housing 1 at the bottom of the displacement chamber. The disc 10 has a centrally formed hole therein. The shape of the hole conforms to the cross-section of the piston shaft 3 but is smaller than the cross-sectional size of the piston shaft. Since piston shafts are typically cylindrical, in the preferred embodiment, the hole is circular and its diameter is less than that of the piston shaft. Thus, in a practical embodiment of the invention, a disc formed from PTFE, as discussed further below, and having an outside diameter of 6.2 mm and a hole diameter of 3.1 mm was utilized in a piston pump in liquid chromatography service having a sapphire piston shaft with a diameter of 3.175 mm.

The disc 10 is formed from an elastic material so that forcing the piston shaft through the hole in the disc causes the edges of the hole to encircle and press against the surface of the shaft. Thus, the disc 10 acts as a scraper which removes the particles deposited on the shaft as a result of seal wear and prevents the shaft from carrying them into the fluid during its inward stroke.

As a result of the hole in the disc being smaller than the diameter of the piston shaft, the seal is deformed by the passage of the shaft through the hole. As shown in FIG. 1, in the preferred embodiment, the deformation causes the disc 10 to assume a conical shape. This deformation of the seal is facilitated by the shape of the displacement chamber. As shown in FIG. 1, the end of the displacement chamber adjacent the disc 10 is conical so that the displacement chamber funnels outward, thereby forming a cavity 9 into which the inner portion of the disc can extend in taking its conical shape. Also, in combination with the porous nature of the seal as discussed below, the conical shape of the displacement chamber 2 ensures good flushability of the seal area and allows gas bubbles formed during operation to be quickly removed.

Although in the preferred embodiment the member 10 is a disc, it is clear that other suitable shapes may be utilized without departing from the teaching disclosed herein—for example, a cylindrically shaped member, having its axis coincident with that of the piston shaft and having a centrally formed hole, may also be used.

As a result of the aforementioned deformation of the disc 10, an annular cavity, adjacent to and surrounding the piston shaft 3, is formed between the outboard surface of the disc and the inboard face of the seal, as shown in FIG. 1. The piston shaft 3 also forms a boundary of the cavity. In operation, the particles released by the seal are captured by the cavity and retained therein, ensuring that the particles do not enter the fluid in the displacement chamber.

Thus, in addition to the aforementioned scraping function, the disc forms a cavity which captures and retains particles released from the seal. Whenever the seal 6 is replaced, the cavity formed by the disc 10 is cleaned out by removing the seal particles retained therein. Further, the disc is arranged so that the cavity it forms communicates with the annular cavity in the seal 6 in which the spring 7 resides, thereby creating additional volume for the storage of particles. It should also be noted that the disc has the advantage of preventing the introduction of gas bubbles into the seal area once the system has been rinsed and is free of gas bubbles.

Although in the preferred embodiment, the cavity is formed by the deformation of the disc 10 by the piston shaft 3, the cavity could also be pre-formed by, for example, using the aforementioned cylindrical member instead of the disc 10.

Its important that the seal area be flushed with fluid to ensure that the seal is rapidly wetted upon startup of the pump, thereby avoiding the excessive wear associated with dry contact between the shaft and seal. Moreover, in some applications, such as liquid chromatography, the composition of the fluid being pumped is varied and it is important that the sealed area be quickly and cleanly rinsed so that no residue of the earlier cycle remains following change over of the fluid. Therefore, according to the current invention, the disc 10 is permeable with respect to the fluid being pumped. In the preferred embodiment, permeability is achieved by forming the disc from a porous PTFE material. Adequate permeability can be obtained in a disc having a thickness of approximately 0.2 mm and utilizing a PTFE material having a porous volume greater than or equal to 30%, an air transmission greater than or equal to 250 ml/(s-cm$^2$-bar) and a water retention power greater than or equal to 0.5 m. When used in liquid chromatography service, PTFE also has the advantage of being chemically inert with respect to the liquids usually used in such applications. Alternatively, the desired permeability can be achieved in a metal disc having a plurality of holes, or a sintering process can be used to make a disc which allows the exchange of fluid.

As a result of the permeability, the fluid being pumped rapidly wets the seal at startup and residues of fluid used in a prior pump cycle are rapidly rinsed from the seal area following fluid change over. Moreover, the permeability of the disc 10 gives rise to a further advantage when the pump is operated in high pressure service—for example 400 bar, as is frequently the case with piston pumps. As a result of the fluid permeability, the pressure differential across the disc is minimized, thereby minimizing the mechanical stress and wear to which the disc is subjected.

The present invention may be embodied in other specific forms without departing from the spirit or essential attributes thereof and, accordingly, reference should be made to the appended claims, rather than to the foregoing specification, as indicating the scope of the invention.

What is claimed is:

1. A pump for pumping a fluid, comprising:

(a) a housing having a chamber formed therein;

(b) a shaft movably disposed in said chamber;

(c) a shaft seal disposed in said housing and surrounding said shaft; and (d) an elastic disc having a centrally formed hole therein, the shape of said hole conforming to the cross-sectional shape of said shaft and the size of said hole being smaller than the cross-sectional size of said shaft when said disc is in an unformed state, whereby said disc is deformed into a conical shape when said shaft extends through said hole, said conical deformation forming a cavity between said disc and said seal for capturing said separated seal particles removed by said disc, thereby preventing said particles from entering said fluid being pumped.

2. The pump according to claim 1, wherein said elastic disc is made from a porous material.

3. The pump according to claim 2 wherein said porous material is a polytetraflourethylene material.

* * * * *